US006450217B2

(12) United States Patent
Mutter

(10) Patent No.: US 6,450,217 B2
(45) Date of Patent: Sep. 17, 2002

(54) SWITCH-OVER DEVICE FOR A FILLING STATION, AND A GAS FILLING STATION

(75) Inventor: Heinz Mutter, Winterthur (CH)

(73) Assignee: GreenField AG, Basil (CH)

( * ) Notice: Subject to any disclaimer, the term of this patent is extended or adjusted under 35 U.S.C. 154(b) by 0 days.

(21) Appl. No.: 09/769,617

(22) Filed: Jan. 23, 2001

(30) Foreign Application Priority Data

Jan. 28, 2000 (EP) ..... 00810079

(51) Int. Cl.[7] ..... B65B 1/04; B65B 3/04; B67C 3/02

(52) U.S. Cl. ..... 141/98; 141/21; 141/39; 141/105; 137/112

(58) Field of Search ..... 141/98, 21, 67, 141/39, 100, 105; 137/110, 112, 267

(56) References Cited

U.S. PATENT DOCUMENTS

| | | | | |
|---|---|---|---|---|
| 2,705,501 A | * | 4/1955 | Fritzsch | 137/112 |
| 3,807,422 A | * | 4/1974 | McJones | 137/110 |
| 4,187,871 A | * | 2/1980 | Hendrickson | 137/112 |
| 5,014,733 A | | 5/1991 | Wilson | |
| 5,676,180 A | * | 10/1997 | Teel | 137/267 |
| 5,899,194 A | * | 5/1999 | Iwatsuki et al. | 123/490 |

FOREIGN PATENT DOCUMENTS

| | | |
|---|---|---|
| DE | 1126436 | 3/1962 |
| DE | 2918791 | 11/1980 |
| EP | 0653585 A1 | 5/1995 |
| FR | 784.770 | 7/1935 |
| FR | 2456273 | 12/1980 |

* cited by examiner

*Primary Examiner*—Timothy L. Maust
(74) *Attorney, Agent, or Firm*—Townsend and Townsend and Crew LLP

(57) ABSTRACT

A switch-over device for a filling station has at least a first and a second input (21 and 22 respectively) for a fluid which is under pressure, and an outlet (9) for the fluid and flow connections (19, 29) via which each input (21, 22) can be connected to the outlet (9). A switch-over valve (42) which has a valve body (421), which can be actuated by the fluid and which in its closure position closes the flow connection (29) between the second input (22) and the outlet (9), is provided in the flow connection (29) between the second input (22) and the outlet (9). Control connections (142, 942) for the fluid are arranged in such a manner that the valve body (421) of the switch-over valve (42) is acted upon on the one side by the pressure of the fluid at the first input (22) and on the other side by the pressure of the fluid at the outlet (9).

15 Claims, 7 Drawing Sheets

SWITCH-OVER DEVICE FOR A FILLING STATION, AND A GAS FILLING STATION

BACKGROUND OF THE INVENTION

The invention relates to a switch-over device for a filling station and to a gas filling station for filling a pressure container with a gas.

Compressed natural gas is gaining above all in importance as an alternative fuel for motor vehicles. In order to enable a satisfactory range for motor vehicles which are operated with natural gas and at the same time to keep the dimensions of the supply container in the motor vehicle within reasonable limits, these supply containers are typically filled up to pressures of about 200 bar with respect to a reference temperature of 15° C. Filling methods and filling stations have been developed for this which enable a very simple and rapid filling of motor vehicles of this kind—comparable to filling with gasoline. A method of this kind and a gas filling station of this kind respectively are shown for example in EP-A-653 585 in detail.

Gas filling stations of this kind, by means of which mobile pressure containers such as e.g. the supply container of a gas-operated motor vehicle are filled with gas, typically comprise a stationary storage unit which is filled with compressed gas and a dispensing apparatus in order to connect the stationary storage unit to the mobile supply container, so that the gas can flow out of the storage unit into the mobile supply container.

In EP-A-653 585 it is proposed that the stationary storage unit comprises a plurality of, especially three, reservoirs. In the dispensing apparatus a switch-over device is provided by means of which one of the reservoirs can in each case be connected to the pressure line which leads to the pressure container to be filled. The switch-over device enables a switching over from one stationary reservoir to another stationary reservoir as source for the filling during a filling operation. Thus if during the filling the pressure difference between the stationary reservoir and the mobile supply container decreases, e.g. as a result of the increasing emptying of the stationary reservoir, to such an extent that the volume flow of the gas with respect to time becomes very low, then a switchover can be made to another reservoir without an interruption of the filling process, in order to ensure a rapid progress of the filling.

In accordance with EP-A-653 585 the mass flow of the gas dispensed is determined by measurement by means of a mass flow meter and the measured value is transmitted to a control apparatus. As soon as the control apparatus detects that the mass flow falls below a predeterminable threshold value during the filling, the control apparatus drives the switch-over device in such a manner that a switchover is made to a reservoir with higher pressure. Although this procedure has proven useful in practice, it is nevertheless relatively complex and cost intensive.

SUMMARY OF THE INVENTION

It is an object of the invention to propose a switch-over device which is as simple and economical as possible and which in particular enables a switching over from one reservoir of a filling station to another as soon as the mass flow falls below a threshold value. In addition, this switching over should be possible without interrupting the filling process for it.

Thus in accordance with the invention a switch-over device for a filling station is proposed which comprises at least a first and a second input for a fluid which is under pressure, an outlet for the fluid and flow connections via which each input can be connected to the outlet. A switch-over valve which has a valve body, which can be actuated by the fluid and which in its closure position closes off the flow connection between the second input and the outlet, is provided in the flow connection between the second input and the outlet. Control connections for the fluid are arranged in such a manner that the valve body of the switch-over valve is acted upon on the one side by the pressure of the fluid at the first input and on the other side by the pressure of the fluid at the outlet.

As long as the switch-over valve is in the closure position, fluid can flow only from the first input to the outlet of the switch-over device. If for example in a gas filling station the first input is connected to a first stationary reservoir and the outlet to the pressure container to be filled, then the fluid flows out of the first reservoir into the pressure container. As a result of the control connections the valve body of the switch-over valve is acted upon on the one side by the pressure of the fluid at the first input and on the other side by the pressure of the fluid at the outlet. The pressure difference which results from this holds the valve body of the switch-over valve in the closure position, so that the flow connection between the second input, which is for example connected to a second stationary reservoir, and the outlet is closed. If the pressure difference falls below a predeterminable threshold value, because for example on the one hand the pressure at the first input decreases and on the other hand the pressure at the outlet increases as a result of the pressure container, which is filled more and more, then the switch-over valve automatically switches into its open position and thereby opens the flow connection between the second input and the outlet. Now the fluid can flow from the second input, thus for example from the second stationary reservoir, to the outlet and then into the pressure container to be filled.

The threshold value of the pressure difference at which the switch-over valve switches can be predetermined in a simple way. For example the valve body can be subjected to a bias force by a correspondingly dimensioned spring. It is also possible to design the area of the valve body which is acted upon by the pressure of the fluid at the first input on the one hand and the area which is acted upon by the pressure of the fluid at the outlet on the other hand to be of different sizes in order thereby to predetermine the threshold value for the pressure difference. In principle all measures which are known per se are suitable in order to predetermine the threshold value for the pressure difference at which the switch-over valve switches.

The switch-over device in accordance with the invention thus has the property that it automatically opens the flow connection between the second input and the outlet as soon as the pressure difference between the first input and the outlet falls below a threshold value. It is in particular not necessary to determine measurement parameters such as e.g. the mass flow of the fluid and to cause the switching over through external drive means. This signifies a considerable reduction in the complexity of the apparatus and in the costs.

Especially in the case of gas filling stations there are applications, e.g. works-internal gas filling stations, in which it is not absolutely necessary to determine by measurement the amount of gas given off during the filling. In such applications the switch-over device in accordance with the invention enables a mass flow meter, such as for example a Coriolis measurement device, to be dispensed with entirely. Since these devices are particularly complicated, expensive and sensitive, costs can be saved to a considerable extent through the switch-over device in accordance with the invention.

In particular in regard to the application in gas filling stations, which frequently comprise at least three stationary reservoirs, the switch-over device preferably has n inputs for the fluid, with n=3, 4, 5, . . . , each of which can be connected via a flow connection to the outlet, wherein a further switch-over valve which has a valve body, which can be actuated by the fluid and which closes the flow connection between the n-th input and the outlet in its closure position, is in each case provided in the flow connection between the n-th input and the outlet, and wherein in each case flow connections for the fluid are arranged in such a manner that the valve body of this switch-over valve is acted upon on the one side by the pressure of the fluid at the (n-1)-st input and on the other side with the pressure of the fluid at the outlet.

In a manner analogous to that described above, the pressure difference between the (n-1)-st input and the outlet holds the switch-over valve which is provided between n-th input and the outlet in its closure position as long as this pressure difference is greater than a predeterminable threshold value. If the pressure difference falls below this threshold value, then the switch-over valve switches into the open position and thereby opens the flow connection between the n-th input, which is for example connected to an n-th reservoir, and the outlet. Now the fluid can flow from the n-th input to the outlet.

The switch-over device thus successively and automatically opens the flow connection between the next, for example the n-th, input and the outlet as soon as the pressure difference between the (n-1)-st input and the outlet falls below a threshold value.

Each switch-over valve preferably comprises a spring element which acts on and stresses the valve body of the switch-over valve, with setting means being provided in order to vary the stressing of the valve body which is caused by the spring element. Through this measure the pressure difference at which the switch-over valve switches from the closure into the open position can be predetermined in a particularly simple and reliable way.

Furthermore, for practical reasons, designs are preferred in which the respective flow connections, via which the inputs can be connected to the outlet, unite downstream from the switch-over valve or the switch-over valves respectively to form a common outlet line.

In a particularly preferred embodiment the switch-over device comprises a single-piece block at which all inputs and the outlet are provided, with all flow connections and all control connections being designed as bores in the single-piece block, and with bores furthermore being provided for the reception of each valve body. This single-piece block enables a particularly compact and space-saving design. In addition the single-piece design is advantageous in regard to leakage losses. The single-piece block with the bores furthermore brings about the advantage that lines and connection elements such as for example screw connections can largely be dispensed with. Through this the operating safety increases, since the risk of damage to lines or to connections between lines respectively is considerably reduced.

Furthermore, a pressure limiting valve which has a valve body which is arranged in a bore of the single-piece block in such a manner that it opens or closes the passage through the common outlet line depending on its position is advantageously provided. This pressure limiting valve serves for example in a gas filling station to terminate the filling process as soon as the final pressure has been reached in the pressure container to be filled.

It is also advantageous when the pressure limiting valve comprises a spring element which acts on and stresses the valve body of the pressure limiting valve, with means being provided in order to vary, in dependence on the temperature, the stressing of the valve body which is caused by the spring element. In gas filling it is usually the case that the permissible final pressure at which the filling is terminated depends on the ambient temperature. In gas-operated motor vehicles their supply container is typically filled up to a pressure of about 200 bar with respect to a reference temperature of 15° C. If the filling takes place at an ambient temperature of less than 15° C., then the final pressure at which the filling is terminated must amount to less than 200 bar in order to ensure that when the ambient temperature rises, an impermissibly large pressure does not arise in the supply container of the motor vehicle. On the contrary, at an ambient temperature of more than 15° C. filling can take place up to a final pressure of more than 200 bar without the risk of too high a pressure in the supply container arising. Through the means for varying in dependence on the temperature the stressing of the valve body which is caused by the spring element, the pressure limiting valve automatically adapts the final pressure at which the filling is terminated to the ambient temperature or to the temperature of the gas respectively.

Furthermore, for safety reasons an electromagnetically actuatable blocking valve is preferably provided in the switch-over device for opening and closing the flow connections between the inputs and the outlet. There exists thereby the possibility of closing the outlet immediately by means of an electrical signal when for example a fault in the filling station is detected. This electrical signal can e.g. come from a control and monitoring device.

A further advantageous measure consists in providing a filter for filtering the fluid in the region of each input in order to avoid contamination.

Furthermore, it is advantageous to provide a non-return valve in each flow connection between one of the inputs and the outlet. In this at least those non-return valves which are provided in the flow connections between the first to the (n-1)-st input and the outlet preferably comprise in each case setting means by which the pressure difference at which the respective non-return valve opens can be set. Through this measure namely, the pressure difference at which the switch-over valve switches from the closure into the open position can also be set.

Furthermore, a gas filling station for filling a pressure container with a gas is proposed by the invention which comprises at least two reservoirs for the gas and a dispensing apparatus in order to fill the gas from the reservoirs into the pressure container. A switch-over device in accordance with the invention is provided in this gas filling station, with each of the reservoirs being connected to an input of the switch-over device and the outlet of the switch-over device being connectable to the pressure container.

A gas filling station of this kind has the advantage that the switching over from one reservoir to the next one takes place automatically and without the determination of the mass flow being required for this. This signifies a considerable reduction of the complexity and the costs in comparison with known gas filling stations.

In the following the invention will be explained in more detail with reference to exemplary embodiments and with reference to the drawings.

DESCRIPTION OF THE PREFERRED EMBODIMENTS

In the following description, reference will be made to the concrete application in which the switch-over device in accordance with the invention is integrated into a natural gas filling station which serves for filling a pressure container, for example a supply container of a gas-operated motor vehicle, with natural gas. It is self-evident however that the invention is not restricted to such applications; the switch-over device is also suitable for other filling stations, for other liquid and gaseous fluids and in general for applications in which an outlet of a fluid system is to be brought selectively or alternately into flow connection with different inputs for the fluid.

Figure 1:
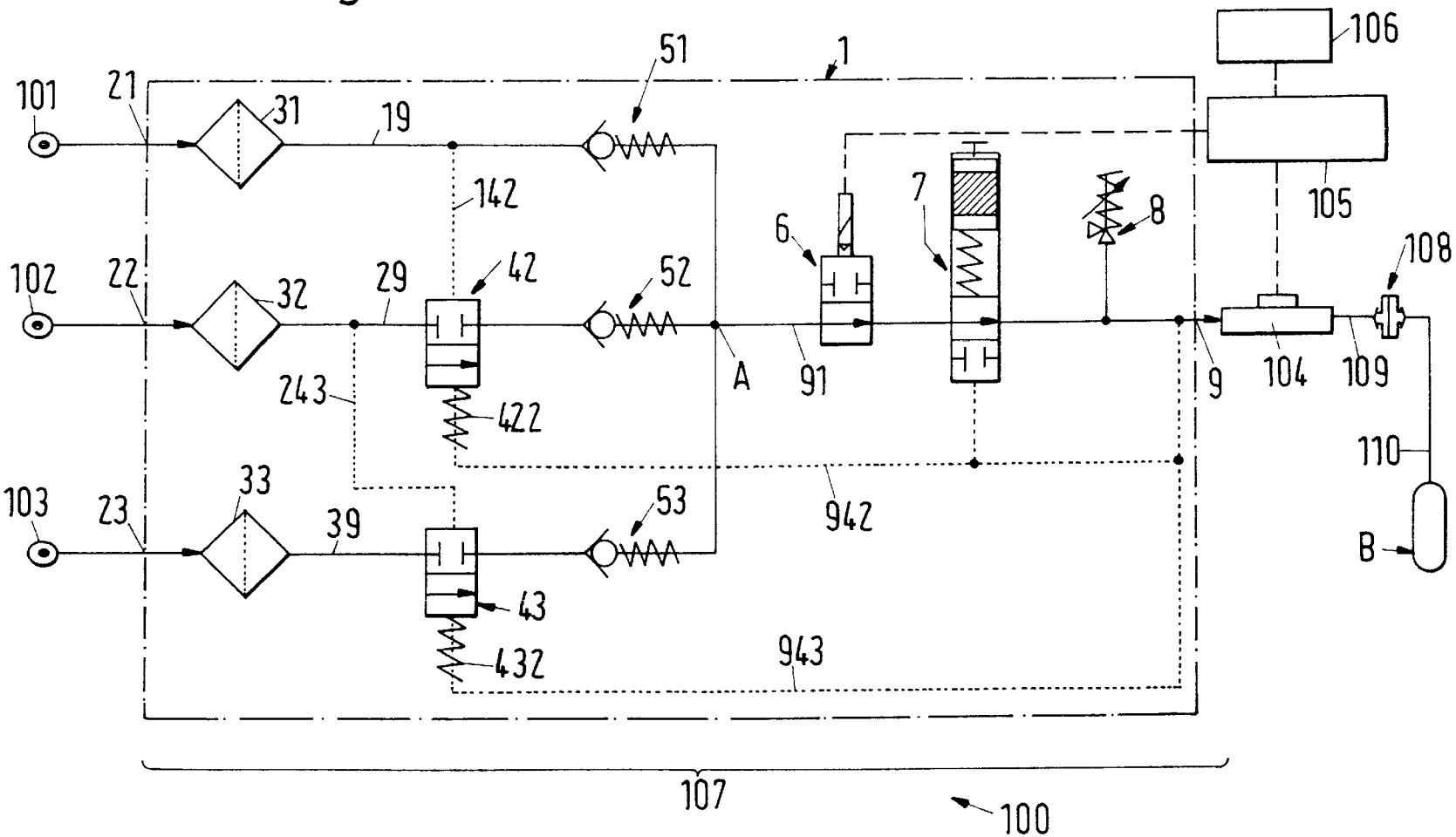
FIG. 1 is a schematic diagram illustrating an exemplary embodiment of a switch-over device in accordance with the invention which is integrated into a gas filling station.

FIG. 1 illustrates in a schematic diagram an exemplary embodiment of a switch-over device 1 in accordance with the invention which is integrated into a gas filling station 100. In this exemplary embodiment the switch-over device 1 comprises three inputs, namely a first input 21, a second input 22 and a third input 23, as well as an outlet 9 for the fluid which is under pressure, here the compressed natural gas. Each input 21, 22 and 23 respectively can be connected via a flow connection 19, 29, 39 to the outlet 9, with a non-return valve 51, 52 and 53 being arranged in each flow connection 19, 29 and 39 respectively.

A filter 31, 32 and 33 respectively by means of which the fluid which flows in through the respective input is filtered is in each case provided in the region of each input 21, 22 and 23 respectively.

A switch-over valve 42 with a valve body 421 (see FIG. 2 and FIG. 3) which in its illustrated closure position closes off the flow connection 29 so that the fluid cannot enter from the second input 22 to the outlet 9 is provided in the flow connection 29 between the second input 22 and the associated non-return valve 52. In the same way a further switch-over valve 43 with a valve body 431 (see FIG. 3) which in its illustrated closure position closes off the flow connection 39 between the third input 23 and the outlet 9 is provided in the flow connection 39 between the third input 23 and the associated non-return valve 53.

The switch-over valves 42, 43 are in each case designed as spring loaded open/close valves which accordingly have in each case an open position and a closure position. For producing the spring loading in each case a spring element 422 and 432 respectively, for example in each case a spiral spring, is provided which acts on and stresses the valve body 421 and 431 respectively. In this the spring element 422 or 432 respectively is in each case arranged in such a manner that it acts upon the valve body 421 or 431 respectively with a force which is directed towards the open position. This means that the valve body 421, 431 of the switch-over valve must in each case be moved into the closure position against the force of the spring element 422 or 432 respectively.

Furthermore, two control connections 142, 942 for the fluid are in each case provided for actuating the switch-over valve 42. The one control connection 142 begins in the flow connection 19 in the vicinity of the first input 21 and extends up to the switch-over valve 42. This control connection 142 is arranged in such a manner that the valve body 421 of the switch-over valve 42 is acted upon on the one side—from above in accordance with the illustration in FIG. 1—by the pressure of the fluid at the first input 21. The other control connection 942 connects the outlet 9 of the switch-over device 1 to the switch-over valve 42 and is arranged in such a manner that the valve body 421 of the switch-over valve 42 is acted upon on the other side—from below in accordance with the illustration in FIG. 1—by the pressure of the fluid at the outlet 9.

In an analogous manner, two control connections 243, 943 are provided for the switch-over valve 43, with the one control connection 243 extending from the flow connection 29 to the switch-over valve 43 and the other control connection 943 connecting the switch-over valve 43 to the outlet 9. Through the control connection 243 the valve body 431 of the switch-over valve 43 is acted upon on the one side—from above in accordance with the illustration in FIG. 1—by the pressure of the fluid at the second input 22; and through the control connection 943 the valve body 431 is acted upon on the other side—from below in accordance with the illustration in FIG. 1—by the pressure of the fluid at the outlet 9.

Figure 2:
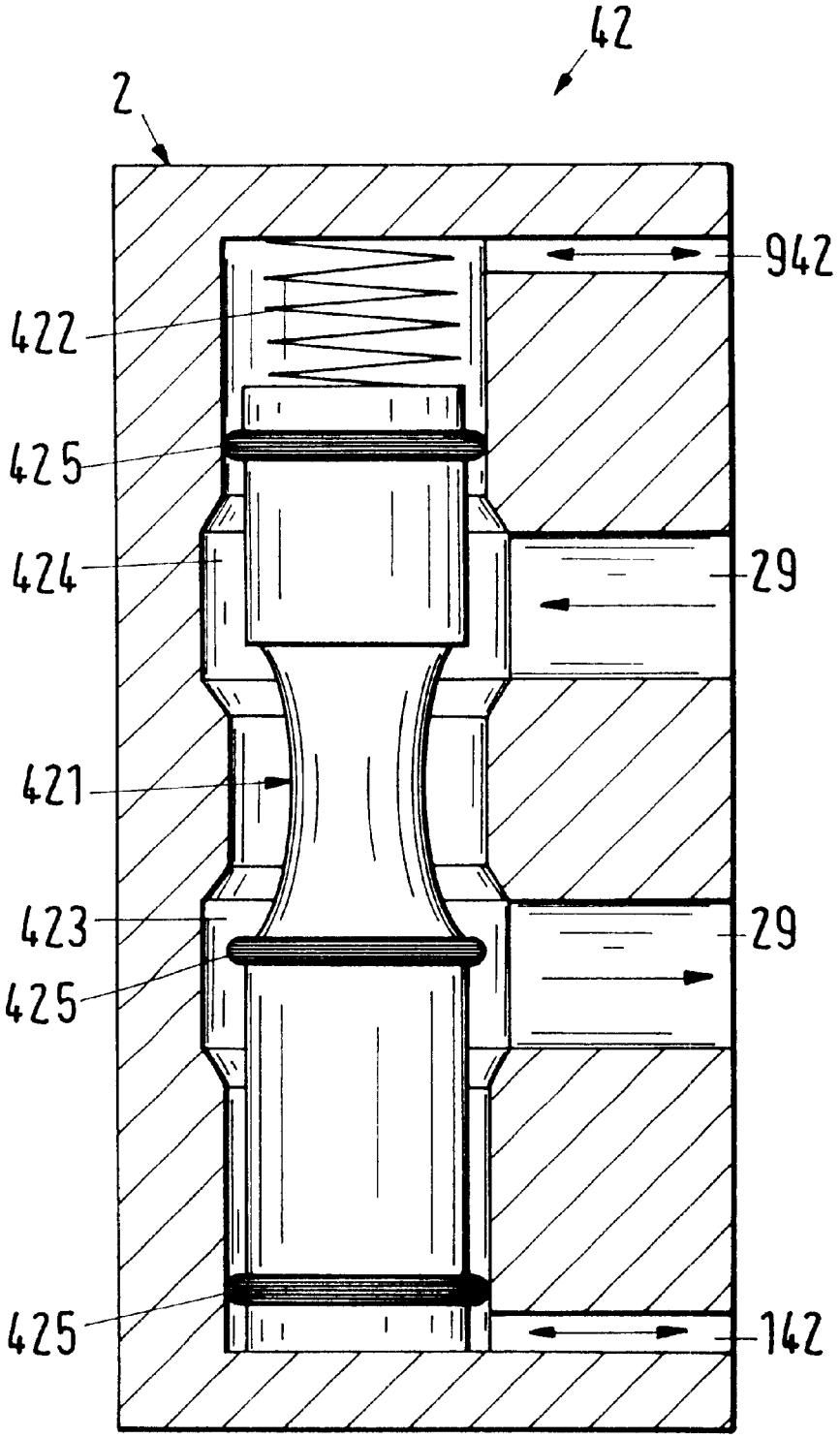
FIG. 2 is a schematic sectional illustration of an exemplary embodiment of a switch-over valve.

For a better understanding, FIG. 2 shows a very schematic sectional illustration of an exemplary embodiment of the switch-over valve 42. The switch-over valve 43 is designed in an analogous manner. The valve body 421 of the switch-over valve 42, which is illustrated in its open position in FIG. 2, is arranged in a bore of a block 2 (see also FIG. 3), said block 2 serving as a valve housing. The bore comprises two ring spaces 423, 424. The flow connection 29 which comes from the second input 22 opens into the ring space 424. The other ring space 423 is connected via the continuation of the flow connection 29 to the common outlet line 91 so that fluid can flow from the input 22 through the ring space 424, the ring space 423 and the common outlet line 91 to the outlet 9 of the switch-over device 1 when the valve body 421 is in its open position which is shown in FIG. 2.

Between the upper side of the valve body 421 in the illustration and the inner wall of the block 2 which lies opposite to it is arranged the spring element 422, which is supported at this inner wall of the block 2 on the one hand and which acts on the upper side of the valve body 421 on the other hand. The spring element 422 exerts a force on the valve body 421 which is directed towards the open position—that is, downwardly in the illustration.

The control connection 942, which is connected to the outlet 9 of the switch-over device 1, opens in the region of the spring element 422 into the bore for the valve body 421 so that its upper side in the illustration is acted upon by the pressure of the fluid at the outlet 9. The control connection 142, which is connected to the first input 21, opens in the region of the lower end of the bore for the valve body 421 in the illustration so that its lower side is acted upon by the pressure of the fluid at the first input 21.

Furthermore, three seals 425, for example in each case O-rings, are provided at the valve body 421. The lower seal 425 in the illustration seals off the control connection 142 against the ring space 423, and the upper seal 425 in the illustration seals off the control connection 942 against the ring space 424. The middle seal 425 seals off the two ring spaces 423 and 424 against one another if the valve body 421 is in the closure position.

In order that the switch-over valve 42 assumes the illustrated open position the sum of the pressure which is exerted by the spring element 422 and the pressure at the outlet 9, which of course likewise bears on the upper side of the valve body 421 via the control connection 942, must be greater than the pressure on the lower side of the valve body 421, which is substantially equal to the pressure of the fluid at the first input 21 as a result of the control connection 142. If this condition is not fulfilled, the switch-over valve switches into the closure position, which means that the valve body 421 moves upwards in the illustration so that the middle seal 425 closes off the passage between the two ring spaces 424 and 423.

Downstream from the three non-return valves 51, 52, 53 (see FIG. 1) and thus downstream from the two switch-over valves 42, 43 the three flow connections 19, 29, 39 unite to form a common outlet line 91 (point A in FIG. 1) which leads to the outlet 9. Provided in the common outlet line 91 are, successively, an electromagnetically actuatable blocking valve 6 (designated in the following as a magnetic valve 6), a pressure limiting valve 7 and, optionally, a safety valve 8 for protecting against excess pressure.

The common outlet line 91 can be opened and closed by means of the magnetic valve 6. The magnetic valve 6 is connected via an electrical signal line to a control and monitoring device 105 of the gas filling station 100. If for example a fault arises in a filling process or a switching off is necessary for some other reason, then the control and monitoring device 105 can close the magnetic valve 6 via an electrical signal so that fluid cannot flow anymore to the outlet 9 from any of the inputs 21, 22, 23.

The pressure limiting valve 7 serves in a normally proceeding filling process as a switch-off valve which closes off the common outlet line 91 when the final pressure which is provided for the filling is reached and thus terminates the filling process. The pressure limiting valve 7 is preferably designed to be temperature compensating, which will be discussed further below.

The optionally provided safety valve 8 is arranged downstream from the pressure limiting valve 7 and ensures the limiting of the pressure. If, for example as a result of a faulty functioning or of a failure of the pressure limiting valve 7, the pressure of the fluid exceeds a maximum permissible value downstream from the pressure limiting valve 7, then the safety valve 8 opens in order that the fluid can flow off through the safety valve 8 and no impermissibly high pressure arises.

The gas filling station 100 for filling a pressure container B comprises a plurality of, here three, stationary reservoirs 101, 102, 103, each of which is connected via a pressure line to one of the inputs 21, 22, 23 of the switch-over device 1, and a dispensing apparatus 107 in order to fill the compressed natural gas from the reservoirs 101, 102, 103 into the pressure container B. The pressure container B is for example the supply container of a gas-operated motor vehicle. The compressed natural gas in the reservoirs 101, 102, 103 is under a pressure of for example 250 bar to 300 bar.

The dispensing apparatus 107 comprises, in addition to the switch-over device 1, the control and monitoring device 105 for the gas filling station 100, a display 106 and a connector coupling 108 which is connected via a pressure line 109 to the outlet 9 of the switch-over device 1. On the other hand the connector coupling 108 is connectable via a dispensing line 110 to the pressure container B to be filled. A flow meter 104 is also optionally provided in the pressure line 109 between the outlet 9 of the switch-over device 1 and the connector coupling 108 in order to determine by measurement the mass of the natural gas which is given off to the pressure container B. The flow meter 104 is connected via a signal line to the control and monitoring device 105, which calculates the amount of natural gas given off on the basis of the measurement signals of the flow meter 104 and makes it visible on the display 106, possibly as well as further quantities, for example the price.

With respect to further details, possible designs, modes of operation and operating procedures of the gas filling station, reference is made here to the already cited EP-A-653 585.

In the following the mode of operation of the switch-over device 1 will be described with reference to a filling process. In this the initial situation will be assumed with exemplary character in which each of the reservoirs 101, 102, 103 contains natural gas under a reservoir pressure of about 250 bar. Assume that the pressure container B which is connected to the connector coupling 108 contains natural gas under an initial pressure of for example 40 bar and is to be filled up to a final pressure of 200 bar—with respect to a reference temperature of 15° C.

At the beginning of the filling a large pressure difference bears on the valve body 421 of the switch-over valve 42, since the latter is acted upon on the one side via the control connection 142 by the pressure of the natural gas at the first input 21, which is substantially, which means, disregarding frictional losses, equal to the reservoir pressure, and is acted upon on the other side via the control connection 942 by the pressure of the natural gas at the outlet 9, which is equal to the initial pressure in the pressure container B disregarding frictional losses. Through this pressure difference the switch-over valve 42 is held in the closure position against the force of the spring element 422, so that the flow connection 29 between the second input 22 and the outlet 9 is closed off. An analogous statement holds for the switch-over valve 43. The latter is held in the closure position by the pressure difference between the second input 22, where substantially the reservoir pressure of the second reservoir 102 is present, and the outlet 9 against the force of the spring element 432, so that the flow connection 39 between the third input 23 and the outlet 9 is also closed off.

As a result, compressed natural gas can flow through the switch-over device 1 into the pressure container B only from the first reservoir 101.

As the filling process progresses, the pressure difference which holds the switch-over valve 42 in the closure position decreases since on the one hand the reservoir pressure in the first reservoir 101 decreases and on the other hand the pressure in the pressure container B and thus also the pressure in the control connection 942 increases. If this pressure difference falls below a predeterminable threshold value, then the switch-over valve 42 automatically switches into the open position, since then the sum of the forces which the spring element 422 and the natural gas exert via the control connection 942 on the valve body 421 becomes greater than the force which the natural gas exerts via the control connection 142 on the valve body 421. The flow connection 29 between the second input 22 and the outlet 9 of the switch-over device 1 is thereby opened, so that natural gas can flow from the second reservoir 102 into the pressure container B.

The switch-over valve 43 in the flow connection between the third input 23 and the outlet 9 continues to remain in the closure position as a result of the pressure difference between the second input 23 and the outlet 9. Only when, in the course of the further filling process (or subsequent filling processes), this pressure difference also falls below a threshold value, then the switch-over valve 43 automatically switches—in a manner analogous to that already described—into the open position and thereby opens the flow connection 39 between the third input 23 and the outlet 9, so that the natural gas can then flow from the third reservoir 103 into the pressure container B.

If the final pressure for the filling process is reached, then the pressure limiting valve 7 switches into the closure position and closes off the common outlet line 91, so that no further natural gas flows into the pressure container B. The filling process is terminated.

The threshold value for the pressure difference at which the switch-over valve 42 or the switch-over valve 43 respectively switches into the open position can be set in a simple way, namely via the bias force which is produced by the respective spring element 422 or 432 respectively, and can be optimized for the respective application. If for example value is set on an ideal exploitation of the reservoirs 101, 102, 103, then weak springs are preferably used, so that the switch-over valves 42 and 43 respectively switch into the open position only at low pressure differences. If one is interested in as rapid a filling as possible, then stiffer springs are used for the spring elements 422 and 432 respectively, so that the switch-over valves 42 and 43 respectively already switch into the open position at greater pressure differences. Of course, the pressure difference at which the switching over takes place can be set individually for each switch-over valve 42 and 43 respectively through corresponding dimensioning of the spring element 422 and 432 respectively.

Figure 6:
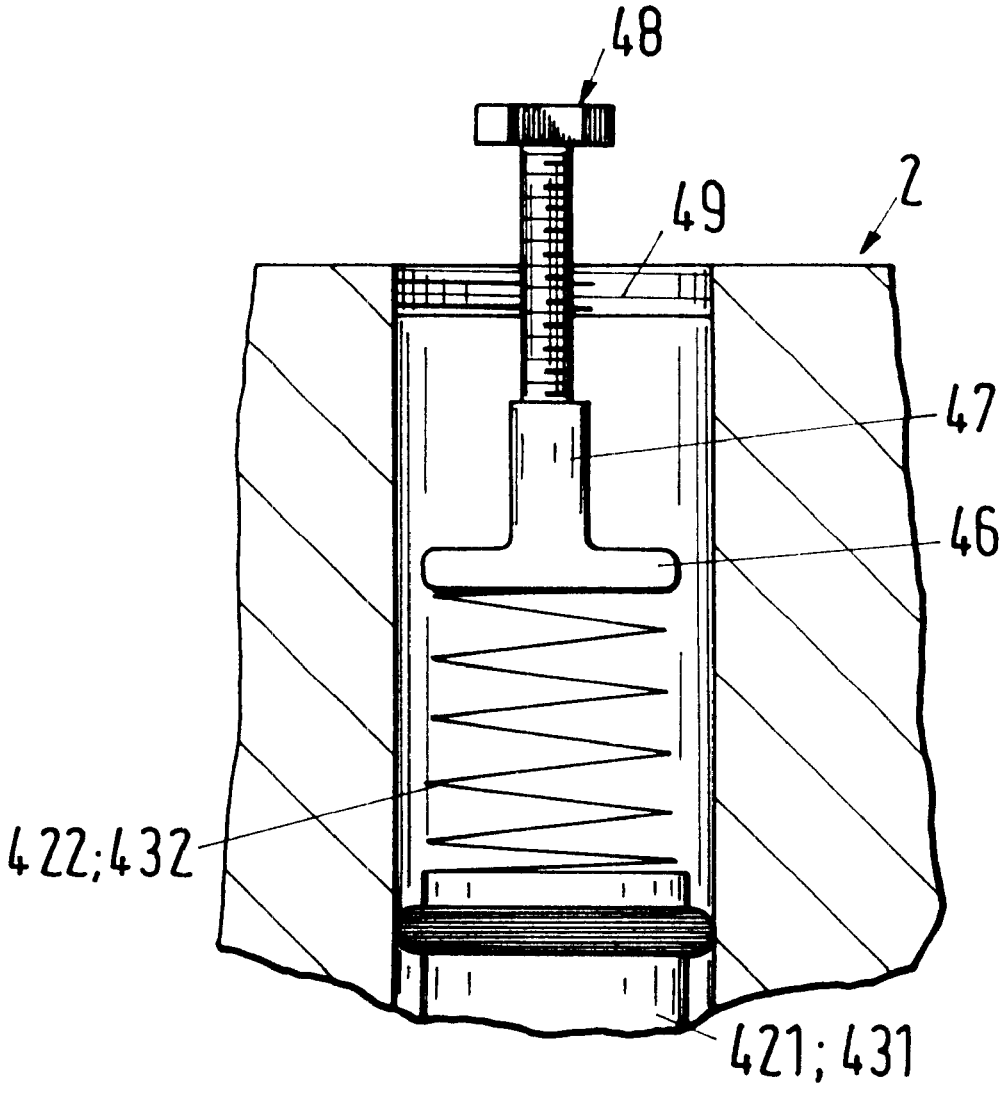
FIG. 6 shows a possible design of setting means for a switch-over valve or a non-return valve.

An advantageous measure for the switch-over valves 42, 43 of the switch-over device 1 consists in providing setting means in order to vary the stressing of the valve body 421 and 431 respectively which is caused by the spring element 422 and 432 respectively. In FIG. 6 a possibility of setting means of this kind is illustrated. The spring element 422 or 432 respectively is supported with its end which faces away from the valve body 421 or 431 respectively on a tappet disk 46 at which a tappet 47 adjoins. The tappet 47 is in active connection with an adjusting screw 48 which is guided in a fixed thread 49. Through rotating the adjusting screw 48 the tappet 47 can be moved upwards and downwards in the illustration, through which the tension of the spring element 422 and 432 respectively can be varied from the outside and thereby the stress on the valve body 421 and 431 respectively which is caused by the spring element. In this way the threshold value for the pressure difference at which the switch-over valve 42 and 42 respectively opens can be set in a simple way without conversion work at the switch-over valve 42 or 43 respectively being necessary. For safety reasons the threshold value is not set arbitrarily small, but is chosen sufficiently large to ensure that the switch-over valve can also open reliably against the frictional forces, which are always present in practice.

A further advantageous measure consists in stressing with strong springs in particular the non-return valves 51 and 52 (see FIG. 1) which are arranged in the first or second flow connection 19 or 29 respectively in each case downstream from the confluence of the control connection 142 or 243 respectively. Thereby a large pressure drop over the switch-over valve 42 or 43 respectively can on the one hand be in each case generated. This large pressure drop is favorable in order to reliably close the switch-over valve 42 or 43 respectively. On the other hand high flow rates can be achieved after the opening of the non-return valve 51 or 52 respectively, which is favorable in regard to a rapid filling.

In accordance with a preferred variant at least those non-return valves 51, 52 which are provided in the flow connections 19, 29 between the first and the second input 21 and 22 respectively and the outlet 9 comprise in each case setting means by which the pressure difference at which the respective non-return valve 51 or 52 respectively opens can be set. This pressure difference will be designated in the following as the opening pressure of the non-return valves. The setting means can be designed analogously as was explained above in connection with FIG. 6 for the switch-over valve; this means that the non-return valve 51 or 52 respectively comprises a spring (analogous to the springs 422; 432 in FIG. 6), against the force of which the non-return valve must be opened in the pass-through direction. The tension of the spring can be set via an adjusting screw (analogous to the adjusting screw 48 in FIG. 6), through which the opening pressure of the non-return valve 51 or 52 respectively can be set.

This variant brings about the advantage that the flow rate at which the switch-over valve 42 or 43 respectively opens can be set with the help of the non-return valves 51 and 52 respectively. This will be explained in more detail in the following with reference to FIG. 7 and using the non-return valve 51 as an example. The explanations hold in an analogous manner for the non-return valve 52.

Figure 7:
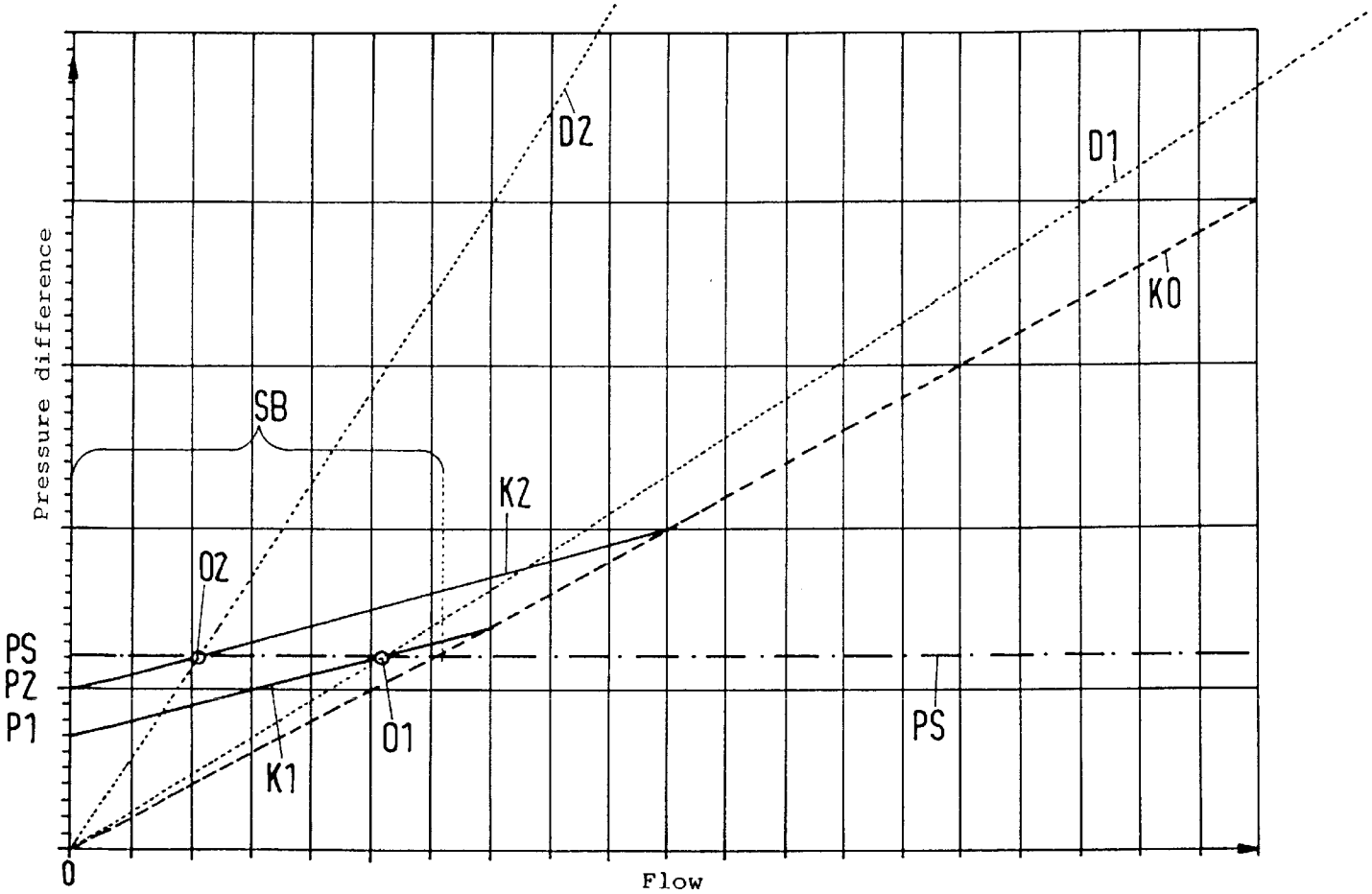
FIG. 7 is a diagram with characteristic curves of a non-return valve.

FIG. 7 shows different characteristic curves for the non-return valve 51 in a simplified illustration. The flow through the non-return valve 51 is plotted on the horizontal axis (increasing to the right) and the pressure difference which falls off across the non-return valve is plotted on the vertical axis (increasing upwardly). Frictional losses are not taken into account in these characteristic curves. The characteristic curve which is designated by K0 and is illustrated with a broken line reproduces the flow through the non-return valve 51 in relation to the time in dependence on the pressure difference or on the pressure drop across the non-return valve 51 respectively for the case that the non-return valve 51 contains no spring, that is, is not stressed. The characteristic curves K1 and K2 reproduce the flow for the case that the non-return valve 51 is stressed by a spring, with the characteristic curve K1 resulting for a less strongly biased spring and the characteristic curve K2 resulting for a more strongly biased spring in the non-return valve 51.

The characteristic curve K1 begins at the opening pressure P1, which means that the pressure difference between the left side of the non-return valve 51 in the illustration in FIG. 1 and the point A must amount to at least P1 in order that the fluid can flow from the first input 21 via the non-return valve 51 to the outlet 9. As the pressure difference increases, the flow also increases in accordance with the characteristic curve K1. With increasing pressure difference the characteristic curve K1 converts into the characteristic curve K0. The characteristic curve K2, which represents the case of a more strongly biased spring in the non-return valve 51, accordingly begins at a higher opening pressure P2, extends at first approximately parallel to the characteristic curve K1 and then converts into the characteristic curve K0.

As can be seen in particular in the illustration in FIG. 1, the pressure drop across the non-return valve 51 is substantially, which means, disregarding frictional losses, of a magnitude equal to the pressure difference which bears on the switch-over valve 42 as a result of the fluid. If this pressure difference—as explained above—exceeds a predeterminable threshold value, then the switch-over valve 42 switches into the open position and opens the flow connection 29 between the second input 22 and the outlet 9. An example for this threshold value is illustrated in FIG. 7 by the chain-dotted line with the reference symbol PS. It is self-evident that the opening pressure P1 and P2 respectively of the non-return valve 51 is set such that it is less than the switching pressure of the switch-over valve 42, which means, less than PS.

When the filling starts, then the pressure difference or the pressure drop respectively is relatively large; one is located at the right on the characteristic curve K0 in FIG. 7. The switch-over valve 42 is in the closure position since the pressure difference which bears on it is greater than PS. As the filling process progresses the pressure difference decreases, which means that one at first moves along the characteristic curve K0 to the left and then, depending on the set bias force of the spring in the non-return valve 51, for example further to the left along the characteristic curve K1 or K2. Accordingly the flow decreases. As soon as the pressure difference falls below the threshold value PS—in the case of the characteristic curve K1 or K2 respectively this takes place at the point O1 or O2 respectively—the switch-over valve 42 switches into the open position. As FIG. 7 shows, the flow at which the switch-over valve opens is less in the case of the characteristic curve K2 than in the case of the characteristic curve K1, which means that the minimum value for the flow, on the falling below which the switch-over valve 42 switches into the open position, can be set via the bias force of the spring in the non-return valve 51 in a simple way. The range within which the lower threshold for the flow can be set for a predetermined threshold value PS with the help of the setting means of the non-return valve 51 is shown in FIG. 7 by the bracket with the reference symbol SB.

The non-return valve 51 thus ensures on the one hand that a sufficiently large pressure difference bears on the switch-over valve 42 in order to hold the latter in the closure position. On the other hand it enables very high flow rates.

In principle a restrictor is also suitable for achieving a sufficiently large pressure difference across the switch-over valve 42. With the former, however, flow rates which are as high as with the non-return valve 51 cannot be achieved. In order to illustrate this, two further typical characteristic curves D1 and D2 of restrictors, which extend through the switching points O1 and O2 respectively, are drawn in FIG. 7. It can be clearly recognized that for a predetermined pressure difference which is greater than PS, the flow through the restrictors is in each case substantially lower that the flow through the non-return valve at the same pressure difference. For this reason non-return valves 51 and 52 respectively are preferred.

Figure 3:
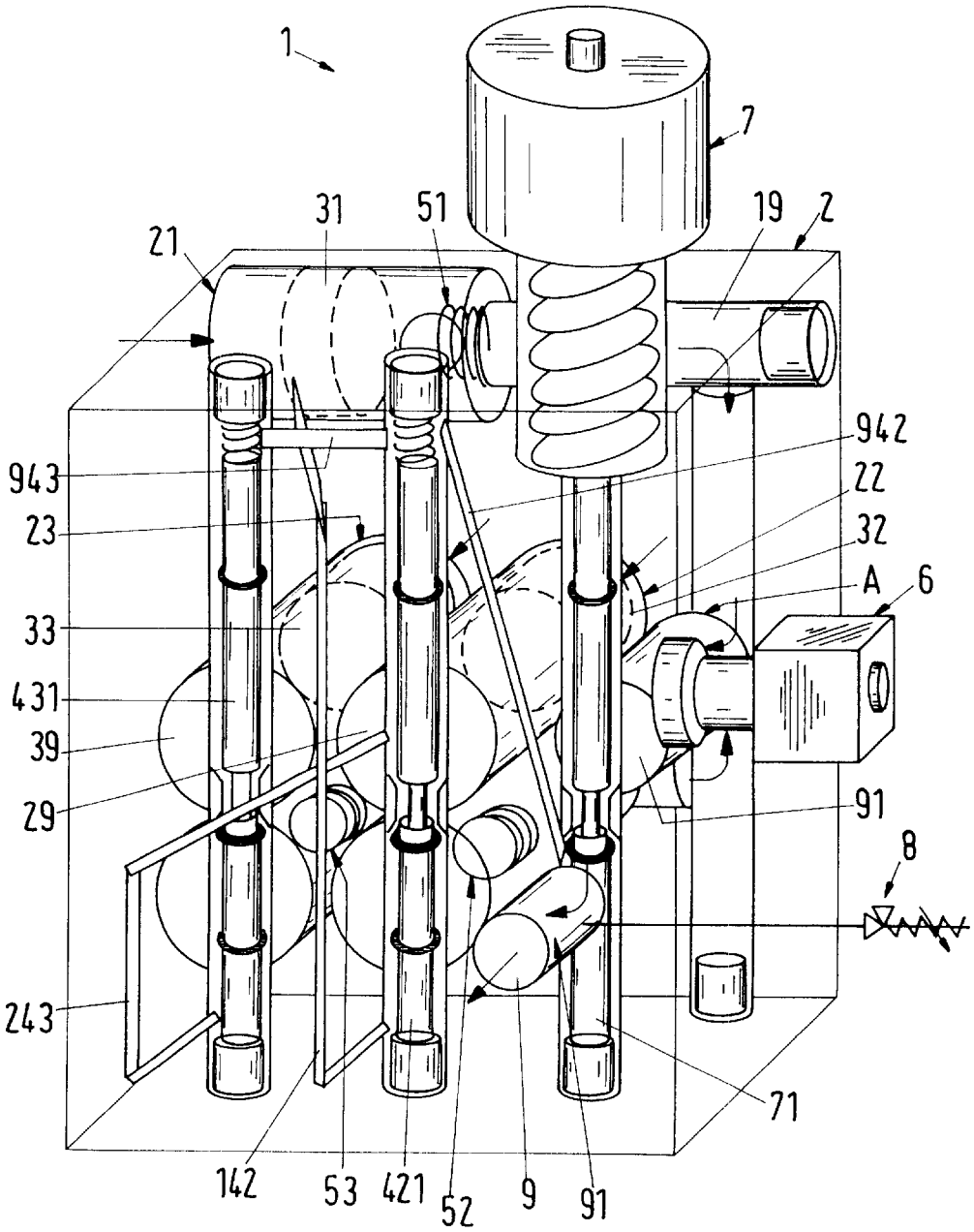
FIG. 3 is a perspective schematic illustration of an embodiment of a switch-over device in accordance with the invention.
Figure 4:
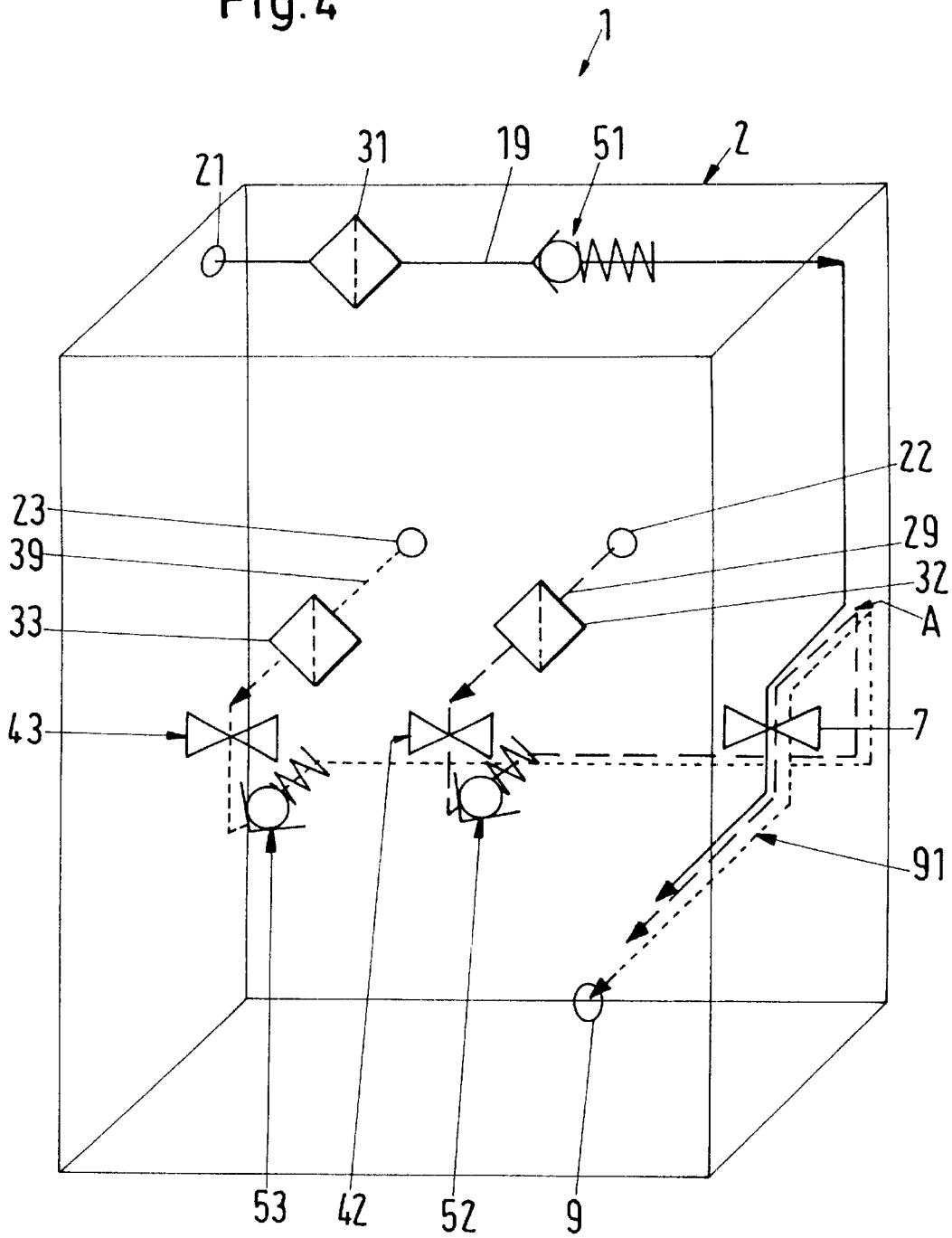
FIG. 4 is a perspective schematic illustration of the flow connections.

FIG. 3 shows in a perspective schematic illustration a particularly preferred embodiment of the switch-over device 1 in accordance with the invention, which is realized in accordance with the schematic diagram which is illustrated in FIG. 1. The reference symbols in FIG. 3 have the same meaning which was already explained. For a better understanding FIG. 4 shows the individual flow connections in an illustration which is analogous to FIG. 3, with the valves and filters being schematically indicated (the flow connections, the magnetic valve and the safety valve are not illustrated). In the following description the position designations such as above, below, right, left, etc. relate to the illustrations in FIG. 3 and FIG. 4.

In this embodiment the switch-over device 1 comprises a single-piece block 2 at which all inputs 21, 22, 23 and the outlet 9 are provided. All flow connections 19, 29, 39 and all control connections 142, 942, 243, 943 are realized as bores in the single-piece block 2. Furthermore, bores for the reception of the valve bodies 421, 431 of the switch-over valves 42, 43 and of the valve body 71 of the pressure limiting valve 7 are provided in the block 2. The bores for the valve bodies 421, 431 are formed in the same way as is illustrated in FIG. 2 for the switch-over valve 42. The single-piece block 2 thus also serves as a valve housing for the switch-over valves 42, 43.

The first input 21 is located in the rear upper corner of the left side wall of the block 2. The flow connection 19 extends from there via the filter 31 and the non-return valve 51 up to the right side wall of the block 2, bends downwardly there and opens into the common outlet line 91 at the point which is designated by A. This flow connection 19 is represented in FIG. 4 by the solid line.

The second input 22 is located midway down the rear wall of the block 2. From the second input 22 the flow connection 29 extends forward via the filter 32 to the bore for the valve body 421 of the switch-over valve 42. From this bore the flow connection 29 extends backward at a lower level via the non-return valve 52, bends off to the right ahead of the rear wall of the block 2, then extends up to the vicinity of the right side wall of the block 2 and then enters into the common outlet line 91 from below at the point A. This flow connection 29 is illustrated in broken lines in FIG. 4.

The third input 23 is located at the rear wall of the block 2 to the left adjacently to the second input 22. The flow connection 39 extends forward from the third input 23 via the filter 33 to the bore for the valve body 431 of the switch-over valve 43. From this bore the flow connection 39 extends backward at a lower level via the non-return valve 53, bends off to the right ahead of the rear wall of the block 2, unites with the flow connection 29, then extends together with the latter up to the vicinity of the right side wall of the block 2 and then enters into the common outlet line 91 from below at the point A. This flow connection 39 is illustrated in dotted lines in FIG. 4.

The common outlet line 91 begins at the point which is designated by A, extends forwardly from there up to the bore for the valve body 71 of the pressure limiting valve 7 and then leads forwardly from this bore further to the outlet 9, which is provided in the front wall of the block 7.

The magnetic valve by means of which the outlet line 91 can be closed off is arranged between the point A and the bore for the valve body 71 of the pressure limiting valve 7. The safety valve 8, which is symbolically indicated in FIG. 3 for the sake of clarity, is provided downstream from the pressure limiting valve 7 ahead of the outlet 9. The natural gas can escape through the latter in the event that an impermissibly high pressure arises downstream from the pressure limiting valve 7.

The control connection 942, which is designed as a bore, begins in the outlet line 91 downstream from the pressure limiting valve 7 and extends obliquely upwards from there to the upper end of the bore for the valve body 421, where the spring element 422 is also provided. The control connection 943 is designed as a bore which connects the upper end of the bore for the valve body 431 to the upper end of the bore for the valve body 421. The bore which realizes the control connection 142 begins in the flow connection 19 in the vicinity of the first input 21 and extends from there to the lower end of the bore for the valve body 421. The bore which realizes the control connection 243 begins in the flow connection 29 ahead of its confluence into the switch-over valve 42 and extends from there to the lower end of the bore for the valve body 431 of the switch-over valve 43.

The method of operating of the embodiment of the switch-over device 1 which is illustrated in FIG. 3 and FIG. 4 is the same as described above. The single-piece block 2 enables an extremely compact and space-saving embodiment and has in addition the advantage that the risk of line damages and sealing problems are minimized. In the embodiment described here the single-piece block 2 takes over numerous functions with its various elements, namely the filtering of the natural gas, the automatic switching over from one reservoir to another reservoir, the possibility of the electromagnetic switching off by means of the magnetic valve 6 (for increasing the operating safety), the automatic switching off by means of the pressure limiting valve 7 when the final pressure for the filling is reached and the excess pressure protection by means of the safety valve 8. In addition the pressure limiting valve 7 can be designed to be temperature compensating, so that it automatically varies the final pressure for the filling in dependence on the ambient temperature or the temperature of the natural gas.

Of course, such pressure limiting valves 7 in which the closure pressure and thus the final pressure for the filling can be set manually, for example via setting means which are designed analogously as was explained in connection with FIG. 6, are also suitable in principle.

Figure 5:
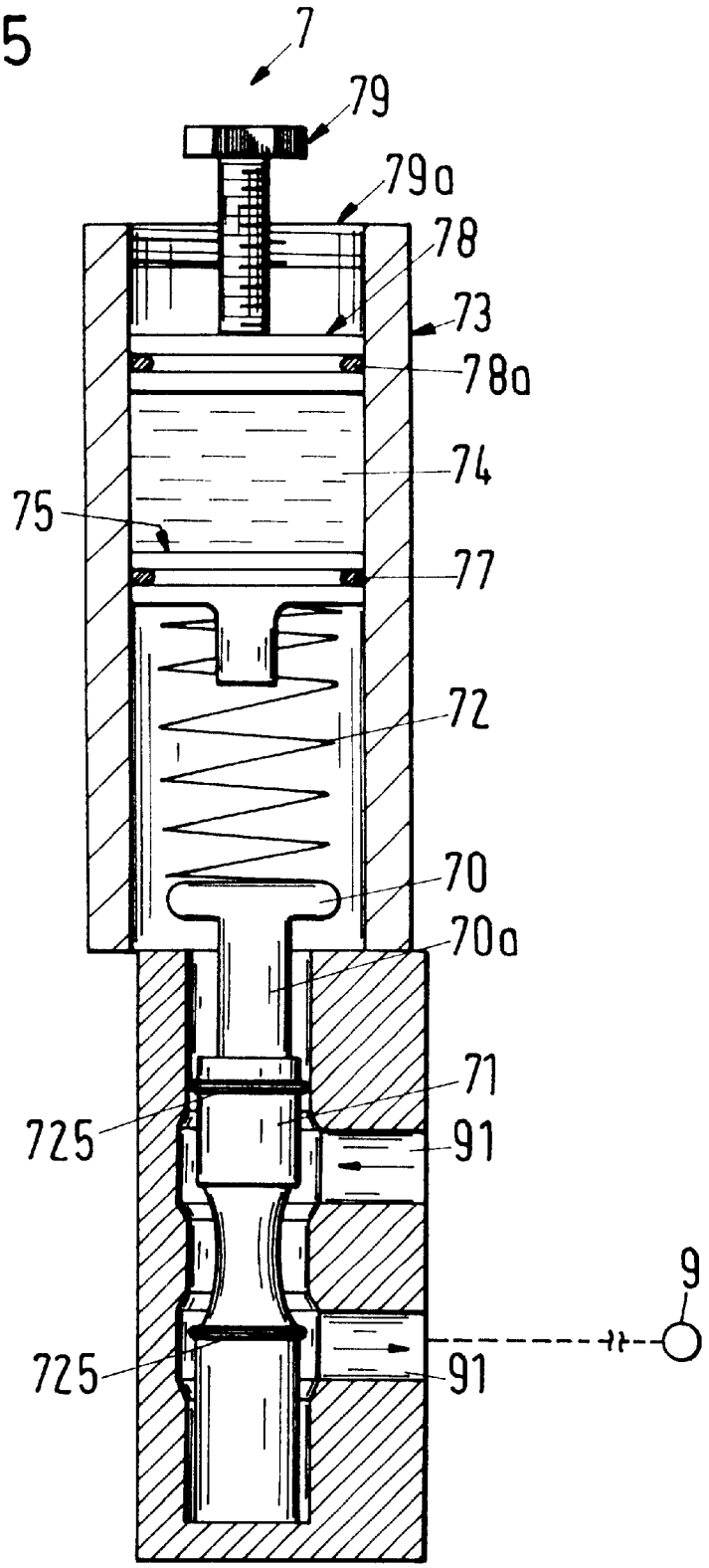
FIG. 5 is a schematic sectional illustration of an exemplary embodiment of a pressure limiting valve.

FIG. 5 shows in a schematic sectional illustration an exemplary embodiment of a pressure limiting valve 7 with automatic temperature compensation. The pressure limiting valve 7 is illustrated in its open position. The pressure limiting valve 7 comprises, in a manner which is analogous to that which has been explained in connection with FIG. 2 for the switch-over valve 42, a spring element 72 which acts on and stresses the valve body 71. The valve body 71 is guided in a bore which comprises two ring spaces and is provided with two seals 725, e.g. O-rings. The ring spaces are in each case connected to the outlet line 91. In the closure position the lower seal 725 in the illustration closes the passage between the two ring spaces, as has already been explained above with reference to FIG. 2. The spring element 72 is arranged in such a manner that it exerts a force on the valve body 71 which acts in the direction towards the open position—thus downwardly in the illustration—which means that the pressure limiting valve 7 must be brought into the closure position or held in it respectively against the force of the spring element 72. On the other side the valve body 71 is acted upon by the pressure of the fluid at the outlet 9. If this pressure exceeds the pressure caused by the spring element 72, then the pressure limiting valve 7 closes, which means that the valve body moves upwards in the illustration.

Means are provided in order to vary the stressing of the valve body 71 which is caused by the spring element 72 in dependence on the temperature. These means comprise in the exemplary embodiment which is illustrated in FIG. 5 a hollow cylindrically shaped container 73 with a liquid 74, for example an oil, which preferably has a thermal coefficient of volume expansion of at least $5 \cdot 10^{-4}$ $K^{-1}$. The container 73 is arranged and designed in such a manner that through its thermal expansion the liquid 74 varies the stressing of the valve body 71 which is caused by the spring element 72 in dependence on the temperature. The spring element 72 is supported with its one end on a tappet disk 70 at which a tappet 70*a* adjoins which presses against the upper end surface of the valve body 71 in the illustration. On the other side the spring element 72 protrudes into the container 73 and is supported with its other end on a movable pressure piston 75 which is passed through the inner wall of the container 73. A seal 77, for example an O-ring, is provided between the pressure piston 75 and the inner wall of the container 73. The inner space of the container 73 is bounded at its upper side in the illustration by an adjusting piston 78, the diameter of which substantially corresponds to the inner diameter of the container 73 and is provided with a seal 78*a*, e.g. an O-ring. The adjusting piston 78 is connected to a setting screw 79 which is provided outside the container 73 and which is guided in a thread section 79*a* which is fixed relative to the container 73. By rotating the setting screw 79 the adjusting piston 78 can be moved upwards and downwards in the illustration, through which the volume which is available to the liquid 74 can be varied. Since the pressure limiting valve 7 is set or adjusted respectively by rotating the setting screw at a reference temperature, e.g. 15° C., to the correct closure pressure for this temperature, e.g. 200 bar, the adjusting piston 78 remains in a position which is fixed by the setting screw 79 during normal operation.

If now the pressure at the outlet 9 reaches the closure pressure of 200 bar, which is equal to the desired final pressure for the filling, at a temperature of 15° C., then the valve slider 71 is moved upwards in the illustration against the force of the spring element 72, and the pressure limiting valve 7 then closes the passage through the outlet line 91.

The liquid 74 in the container 73 changes its volume as a result of its thermal expansion. If for example the temperature of the liquid 74 increases, then its volume increases. Through this increase in volume the spring element 72 is compressed, through which the stressing of the valve body 71 which is caused by the spring element 72 increases. Thus the closure pressure at which the pressure limiting valve 7 closes also increases, which means that the final pressure for the filling is automatically increased. Conversely, the liquid 74 decreases its volume when the temperature decreases. The spring element 72 is thereby somewhat relaxed and the stressing of the valve body 71 is reduced. As a result the closure pressure at which the pressure limiting valve 7 closes falls and thereby terminates the filling process. Thus the pressure limiting valve 7 automatically varies its closure pressure in dependence on the temperature, through which a temperature dependent pressure limiting is enabled in a simple way. The increasing of the closure pressure with the temperature can be set to the desired value in a simple way via the amount of the liquid 74 in the container 73. This increasing preferably amounts to 1.5 bar/K to 2 bar/K for natural gas since this value corresponds to the pressure-temperature behavior of natural gas.

A temperature compensating pressure limiting valve 7 of this kind is for example disclosed in the European patent application No. 99810545.6 of the present applicant, to which reference is made for further explanations.

It is self-evident that the switch-over device in accordance with the invention can in an analogous manner also have more than three inputs or only two inputs.

Furthermore, a separate valve, which means one which is not integrated into the single-piece block 2, can be provided in the gas filling station 100 in accordance with the invention in order to terminate the filling process when the final pressure is reached. This valve is then provided downstream from the switch-over device. It is also possible to calculate the final pressure for the filling in dependence on the current temperature, which can for example be determined by measurement by means of a temperature sensor, in the control and monitoring device 105 or to look it up in a stored table. Then the control and monitoring device 105 terminates the filling process in an electrical or electronic way, e.g. via the drive of an electromagnetic valve, when the determined final pressure is reached. In designs in which a separate valve which is not integrated into the single-piece block 2 is provided for the termination of the filling process, the pressure limiting valve 7 in the block 2 of the switch-over device 1 can be dispensed with, or the pressure limiting valve 7 is used as an additional safety valve.

What is claimed is:

1. Switch-over device for a filling station comprising at least a first input and a second input for a fluid which is under pressure, an outlet for the fluid having flow connections via which each input can be connected to the outlet, a switch-over valve in the flow connection between the second input and the outlet which has a valve body, which can be actuated by the fluid and which in its closure position closes the flow connection between the second input and the outlet, control connections for the fluid arranged in such a manner that the valve body of the switch-over valve is acted upon on one side by pressure of the fluid at the first input and on the other side by pressure of the fluid at the outlet, and a single-piece block at which all inputs and the outlet are provided, wherein all flow connections and all control connections comprise bores in the single-piece block, and wherein bores are furthermore provided for the reception of each valve body.

2. Switch-over device in accordance with claim 1, comprising n inputs for the fluid, with n=3, 4, 5, . . . , each of which can be connected via a flow connection to the outlet, wherein a further switch-over valve which has a valve body, which can be actuated by the fluid and which closes the flow connection between the n-th input and the outlet in its closure position, is in each case provided in the flow connection between the n-th input and the outlet, and wherein control connections are in each case arranged for the fluid in such a manner that the valve body of this switch-over valve is acted upon on the one side by the pressure of the fluid at the (n-1)-st input and on the other side by the pressure of the fluid at the outlet.

3. Switch-over device in accordance with claim 1, wherein each switch-over valve comprises a spring element which acts on and stresses the valve body of the switch-over valve, and setting means for varying the stressing of the valve body caused by the spring element.

4. Switch-over device in accordance with claim 1, in which the respective flow connections, via which the inputs can be connected to the outlet, unite downstream from the switch-over valve to form a common outlet line.

5. Switch-over device in accordance with claim 4, comprising a pressure limiting valve which has a valve body which is arranged in a bore of the single-piece block in such a manner that it opens or closes the passage through the common outlet line depending on its position.

6. Switch-over device in accordance with claim 5, wherein the pressure limiting valve comprises a spring element which acts on the valve body of the pressure limiting valve and stresses the latter, wherein means are provided to vary the stressing of the valve body caused by the spring element in dependence on the temperature.

7. Switch-over device in accordance with claim 1, comprising an electromagnetically actuatable blocking valve for opening and closing the flow connections between the inputs and the outlet.

8. Switch-over device in accordance with claim 1, wherein a filter for filtering the fluid is in each case provided in the region of each input.

9. Switch-over device in accordance with claim 1, wherein a non-return valve is in each case provided in each flow connection between one of the inputs and the outlet.

10. Switch-over device in accordance with claim 9, wherein at least those non-return valves which are provided in the flow connections between the first to (n-1)-st input and the outlet each comprise setting means by which the pressure difference at which the respective non-return valve opens can be set.

11. Gas filling station for filling a pressure container with a gas, comprising at least two reservoirs for the gas and a dispensing apparatus for filling the gas from the reservoirs into the pressure container, and a switch-over device, comprising at least a first input and a second input for the gas, an outlet for the gas having flow connections via which each input can be connected to the outlet, a switch-over valve in the flow connection between the second input and the outlet which has a valve body, which can be actuated by the gas and which in its closure position closes the flow connection between the second input and the outlet, control connections for the gas arranged in such a manner that the valve body of the switch-over valve is acted upon on one side by pressure of the gas at the first input and on the other side by pressure of the gas at the outlet, and a single-piece block at which all inputs and the outlet are provided, wherein all flow connections and all control connections comprise bores in the single-piece block, wherein bores are furthermore provided for the reception of each valve body and wherein each reservoir is connected to an input of the switch-over device and the outlet of the switch-over device can be connected to the pressure container.

12. Switch-over device for a filling station comprising at least a first input and a second input for a fluid which is under pressure, an outlet for the fluid having flow connections via which each input can be connected to the outlet, a switch-over valve in the flow connection between the second input and the outlet which has a valve body, which can be actuated by the fluid and which in its closure position closes the flow connection between the second input and the outlet, control connections for the fluid arranged in such a manner that the valve body of the switch-over valve is acted upon on one side by pressure of the fluid at the first input and on the other side by pressure of the fluid at the outlet, and an electromagnetically actuatable blocking valve for opening and closing the flow connections between the inputs and the outlet.

13. Switch-over device for a filling station comprising at least a first input and a second input for a fluid which is under pressure, an outlet for the fluid having flow connections via which each input can be connected to the outlet, a switch-over valve in the flow connection between the second input and the outlet which has a valve body, which can be actuated by the fluid and which in its closure position closes the flow connection between the second input and the outlet, control connections for the fluid arranged in such a manner that the valve body of the switch-over valve is acted upon on one side by pressure of the fluid at the first input and on the other side by pressure of the fluid at the outlet, and a filter for filtering the fluid in the region of each input.

14. Switch-over device for a filling station comprising at least a first input and a second input for a fluid which is under pressure, an outlet for the fluid having flow connections via which each input can be connected to the outlet, a switch-over valve in the flow connection between the second input and the outlet which has a valve body, which can be actuated by the fluid and which in its closure position closes the flow connection between the second input and the outlet, control connections for the fluid arranged in such a manner that the valve body of the switch-over valve is acted upon on one side by pressure of the fluid at the first input and on the other side by pressure of the fluid at the outlet, and a non-return valve in each flow connection between one of the inputs and the outlet.

15. Switch-over device in accordance with claim 14, wherein at least those non-return valves in the flow connections between the first to (n-1)-st input and the outlet each comprise setting means by which the pressure difference at which the respective non-return valve opens can be set.

* * * * *